United States Patent [19]

Nixon

[11] 4,214,025

[45] Jul. 22, 1980

[54] MESH ELECTRODES AND METHOD OF MAKING THEM

[75] Inventor: Ralph D. Nixon, Braintree, England

[73] Assignee: English Electric Valve Company Limited, Chelmsford, England

[21] Appl. No.: 826,956

[22] Filed: Aug. 22, 1977

[30] Foreign Application Priority Data

Aug. 25, 1976 [GB] United Kingdom ..... 35414/76

[51] Int. Cl.[2] ..... H01J 1/46

[52] U.S. Cl. ..... 428/67; 29/25.14; 29/592 R; 29/25.17; 65/52; 140/71.5; 156/89; 156/268; 156/3.9; 156/325; 313/348; 313/395; 428/138; 428/304; 428/432

[58] Field of Search ..... 156/89, 314, 268, 319, 156/298, 325, 309; 428/67, 304, 138, 432; 264/273; 140/71.5; 313/348, 395; 29/592, 25.14, 25.17; 65/52; 427/419 E

[56] References Cited

U.S. PATENT DOCUMENTS

| | | | |
|---|---|---|---|
| 2,163,407 | 6/1939 | Pulfrich | 156/89 |
| 2,577,103 | 12/1951 | Brian | 29/25.14 |
| 2,690,769 | 10/1954 | Brown | 156/306 |
| 2,834,900 | 5/1958 | McCarthy | 313/395 |
| 2,874,449 | 2/1959 | De Rooy et al. | 29/25.14 |
| 2,979,633 | 4/1961 | Harris | 313/395 |
| 3,181,021 | 4/1965 | Day | 313/395 |
| 3,201,628 | 8/1965 | Day | 313/395 |
| 3,305,394 | 2/1967 | Kaiser et al. | 156/89 |
| 3,564,587 | 2/1971 | Ellis | 428/432 |

FOREIGN PATENT DOCUMENTS 1958008 6/1970 Fed. Rep. of Germany .

*Primary Examiner*—William A. Powell
*Assistant Examiner*—J. J. Gallagher
*Attorney, Agent, or Firm*—Diller, Ramik & Wight

[57] ABSTRACT

A mesh electrode for a c.r.t. display device consists of a number of coplanar portions of mesh insulated from each other, and secured to a support plate by means of two layers of refractory compound. The first layer is applied to the support plate and allowed to set before the second layer is applied so as to space the mesh portions from the support plate by at least the thickness of the first layer.

12 Claims, 2 Drawing Figures

MESH ELECTRODES AND METHOD OF MAKING THEM

This invention relates to mesh electrodes, and although of general application, it is particularly suitable for use with display tubes which are the subject of patent application Nos. 6455/76, 28792/76 and 28793/76. In these prior applications a requirement arises to mount a segmented mesh electrode so that it can control the passage of electrons selectively through the different segments, and to enable this to be done it is necessary for the segments to be electrically insulated from each other. This requirement poses manufacturing difficulties since the segments are thin and fragile and must be accurately positioned in relation to each other, and the present invention seeks to provide a mesh electrode which can be readily produced.

According to this invention a method of making a mesh electrode comprises the steps of applying a first coat of a settable refractory compound to one surface of a supporting plate; applying a second coat of settable refractory compound when the first coat is hard; and pressing a sheet of mesh material into the second coat so that it is retained in position substantially parallel to the supporting plate when the second coat is hard.

Normally the supporting plate will be a metal, in which case the settable refractory compound is an electrically insulating material.

The refractory compound is most conveniently applied as a paste or viscous liquid, and preferably it is a glass cement. Suitable glass cements are those marketed by the Corning glass Works under the name Pyroceram. Glass cement of this kind is applied as a thick suspension, and after it has dried it is fired to produce a hard glass.

By applying the refractory compound in two separate coats, the mesh material is held away from the supporting plate by at least the thickness of the first, hard, coat. This insures that it is electrically insulated from the supporting plate.

After the second coat is hard, the mesh material is preferably divided into mutually electrically insulated segments. A high speed narrow grinding wheel can be used which cuts channels through the mesh material and into the refractory compound.

Figure 1:
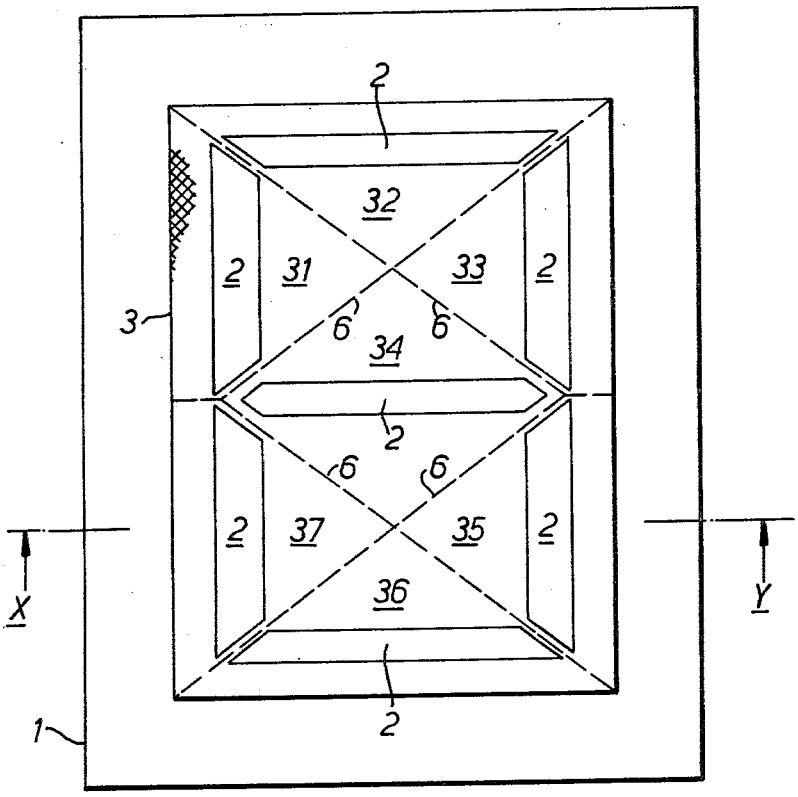
Figure 2:
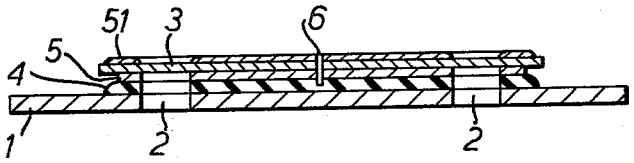

The invention is further described by way of example with reference to the accompanying drawings in which, FIG. 1 illustrates a mesh electrode in accordance with the present invention, and FIG. 2 illustrates a section view taken on the line X-Y.

Referring to the drawings, the mesh electrode consists of a metallic support plate 1 having seven apertures 2 arranged in a figure of eight pattern. The plate 1 supports a sheet of mesh material 3 which is attached via two thin layers 4 and 5 of electrically insulating cement.

A method of making the mesh electrode is as follows.

The apertures 2 are formed in the rectangular metallic plate 1 by any convenient machining process, e.g. punching. The refractory material known as Pyroceram (Pyroceram is a trade name of Corning Glass Works) which is supplied as a fine powder is mixed in a binder of nitrocellulose dissolved in amyl acetate. The mixture is then thickly painted onto the plate 1 to form a first coat 4 and allowed to dry, after which it is fired at a temperature of about 450° C. for some hours. The binder decomposes, and the Pyroceram becomes initially glassy and then forms a ceramic material which cannot subsequently be melted. The particular Pyroceram used is selected to have a coefficient of expansion which is matched with the plate 1 and the mesh material 3.

Subsequently a second coat 5 of the mixture is applied and allowed to dry. The mesh material 3 is applied and a pressure plate is positioned over the mesh whilst the mixture is fired as before. During the firing process some Pyroceram may ooze through the holes in the mesh material, as shown at 51, and this serves to strengthen the bond between the mesh material 3 and the plate 1.

The individual segments 31 to 37 are then formed from the initially continuous mesh material 3 by the use of a high-speed narrow grinding wheel which cuts out the channels 6 to leave each segment insulated from the others and from the plate 1.

The use of the invention enables segmented mesh electrodes to be made which are tautly held in a plane parallel to and very close to the plane of the supporting plate. Although in FIG. 2 the thicknesses of the coats 4 and 5 appear relatively large, these dimensions have greatly been exaggerated for the sake of clarity of illustration.

I claim:

1. A method of making a mesh electrode including the steps of applying a first coat of settable refractory compound to one surface of a supporting plate having a plurality of apertures therein; firing said first coat to harden it and render it subsequently unmeltable; applying a second coat of settable refractory compound when the first coat is hard; pressing a sheet of mesh material into the second coat to bridge the apertures in the supporting plate; and firing the second coat to harden it and render it unmeltable so that said mesh material is retained in position substantially parallel to the supporting plate when the second coat is hard.

2. A method as claimed in claim 1 and wherein the supporting plate is a metal and the refractory compound is an electrically insulating material.

3. A method as claimed in claim 1 and wherein the refractory compound is applied as a paste or viscous liquid.

4. A method as claimed in claim 3 and wherein the refractory compound is a glass cement.

5. A method as claimed in claim 1 and wherein, after the second coat has set, the mesh material is divided into mutually electrically insulated segments.

6. A method as claimed in claim 5 and wherein the division is provided by channels which cut through the mesh material.

7. A mesh electrode made in accordance with claim 1.

8. The method of making a mesh electrode, which comprises the steps of:

(a) forming a coating of refractory material on one surface of a supporting plate having a plurality of apertures therein;

(b) firing the coated plate of step (a) to produce a first ceramic coating on said one surface of the support plate which cannot subsequently be melted;

(c) forming a second coating of refractory material on said first ceramic coating;

(d) firing the coated plate of step (c) while embedding a sheet of mesh material into said second coating to produce a second unmeltable ceramic coating adhered to said first ceramic coating such that said sheet of mesh material overlies said apertures and lies in a plane parallel to said one surface of the support plate and spaced therefrom by a distance at least equal to the thickness of said first ceramic coating.

9. The method as defined in claim 8 including, prior to step (a), the step of forming a pattern of apertures in said support plate and, subsequent to step (d), the step of cutting channels through said second ceramic coating and said sheet of mesh material embedded therein to separate said sheet of mesh material into individual segments overlying respective apertures of said pattern.

10. The method as defined in claim 9 wherein said, refractory material is a glass cement capable, during the firings of steps (b) and (d) of initially becoming glassy and then forming a ceramic material which cannot subsequently be melted.

11. A segmented mesh electrode made in accordance with claim 10.

12. The method of making a segmented mesh electrode, which comprises the steps of:

(a) providing a metallic support plate with a pattern of apertures;

(b) forming a first coating of electrically insulating refractory material on one surface of said support plate, said first coating being fired and incapable of being subsequently melted and adhered to said one surface to define a refractory material supporting surface;

(c) forming a layer of refractory material on said refractory material supporting surface;

(d) pressing a sheet of mesh material into said layer of refractory material while firing same, thereby to form a second coating of unmeltable electrically insulating refractory material and adhere it with said mesh embedded therein to said first coat; and then (e) cutting through said second coating and said mesh to separate said mesh into individual segments overlying respective apertures of said pattern.

* * * * *